US006233953B1

(12) United States Patent
Schill

(10) Patent No.: US 6,233,953 B1
(45) Date of Patent: May 22, 2001

(54) FLAKE ICE MACHINE

(75) Inventor: Joachim Schill, Kehl (DE)

(73) Assignee: Maja-Maschinenfabrik Hermann Schill GmbH, Kehl (DE)

( * ) Notice: Subject to any disclaimer, the term of this patent is extended or adjusted under 35 U.S.C. 154(b) by 0 days.

(21) Appl. No.: 09/485,523

(22) PCT Filed: Aug. 17, 1998

(86) PCT No.: PCT/DE98/02371

§ 371 Date: Feb. 14, 2000

§ 102(e) Date: Feb. 14, 2000

(87) PCT Pub. No.: WO99/09361

PCT Pub. Date: Feb. 25, 1999

(30) Foreign Application Priority Data

Aug. 15, 1997 (DE) ..... 197 35 598

(51) Int. Cl.[7] ..... F25C 5/12
(52) U.S. Cl. ..... 62/135; 62/138; 62/346
(58) Field of Search ..... 62/135, 138, 346

(56) References Cited

U.S. PATENT DOCUMENTS

| | | | | |
|---|---|---|---|---|
| 2,308,541 | * | 1/1943 | Raver | 62/346 |
| 2,749,722 | * | 6/1956 | Knowles | 62/346 |
| 4,459,824 | | 7/1984 | Krueger . | |
| 4,700,551 | * | 10/1987 | Nyrup | 62/346 |
| 5,257,510 | * | 11/1993 | Cox | 62/346 |
| 5,477,694 | | 12/1995 | Black et al. . | |
| 5,913,711 | * | 6/1999 | Visaisouk | 62/346 |

FOREIGN PATENT DOCUMENTS

| | | |
|---|---|---|
| 89 12 336 | 1/1990 | (DE) . |
| 90 02 856 | 7/1990 | (DE) . |
| 41 08 911 | 9/1992 | (DE) . |
| 93 07 466 | 8/1993 | (DE) . |
| 295 17 340 U | 12/1995 | (DE) . |
| 05 35 498 | 4/1993 | (EP) . |

* cited by examiner

*Primary Examiner*—William E. Tapolcai

(57) ABSTRACT

The invention relates to a flake ice machine, comprising an evaporating cylinder (1) and an evaporating pan (2), wherein a sensor is provided to monitor the filling time of the evaporating pan (2), the production of ice and the water level of the water bath (3) available in the evaporating pan (2).

3 Claims, 1 Drawing Sheet

FLAKE ICE MACHINE

BACKGROUND OF THE INVENTION

The invention concerns a flake ice machine having a cylindrical evaporating cylinder, a transmission or transmission motor with electric drive (electric motor) for the evaporating cylinder, a refrigerator, also driven electrically, which guides the cooling means through the evaporating cylinder, an evaporating pan, which can be filled with water, the evaporating cylinder disposed in the evaporating pan in a rotatable manner for wetting the evaporating cylinder with water, as well as means for removing (peeling off or flaking off) the flake ice from the circumference of the evaporating cylinder, and electric control means for the evaporating cylinder and refrigerator drives.

Flake ice machines of this type produce relatively thin flake ice for keeping food fresh, particularly in the meat industry.

A conventional flake ice machine of this kind (DE 41 08 911 A1, EP 535 498 A2) comprises an evaporating cylinder moistened by inserting one side thereof into an evaporating pan filled with water. The evaporating cylinder is turned and residual water freezes on the circumference of the evaporating cylinder. The ice layer thereby generated is removed from the circumference of the evaporating cylinder by a device disposed at the cylinder, before renewed dipping into the water. This is done either by peeling off or by flaking off the ice. The evaporating cylinder contains a cooling evaporator which is connected to a refrigerator disposed outside the cylinder. The refrigerator is preferably a compressor-driven machine. In any event, the refrigerator and the evaporating cylinder drive are controlled electrically via an electric control means. The filling time, the ice production and the water level in the evaporating pan are monitored by the control means to prevent damage to the flake ice machine due to defects in e.g. the evaporating cylinder or refrigerator drives or the water supply. Should the monitored quantities exceed or fall below the predetermined limiting values, the evaporating cylinder and the refrigerator drives are switched off. The control means comprises several sensors for monitoring. One sensor checks the thickness of the ice layer on the circumference and therefore the ice production. Another sensor detects the water level in the evaporating pan and an additional sensor monitors the filling time of the evaporating pan. Each sensor provides a measured value which has to be processed by the control means and compared with the predetermined limiting values. Disadvantageously, these conventional flake ice machines are demanding and expensive to manufacture due to the number of sensors and the corresponding control means.

SUMMARY OF THE INVENTION

In contrast thereto, the flake ice machine according to the invention has the advantage that only one sensor is provided to signal the control means for the evaporating cylinder and the refrigerator, to control the filling time of the evaporating pan, the ice production and the water level in the evaporating pan. The measured value to which the sensor reacts is thereby selected in such a manner that it is sensitive to the filling time, the thickness of the ice layer on the evaporating cylinder and to the water level in the evaporating pan. The control means checks whether the measured values detected by the sensor are within predetermined limits and whether or not the measured values have changed. The limiting values are selected by taking into consideration values for the filling time, the thickness of the ice layer and the water level which are not critical to proper operation of the flake ice machine. If a measured value exceeds the predetermined limiting value, the refrigerator and evaporating cylinder drives are switched off by the control means before the flake ice machine could be damaged.

According to an advantageous embodiment of the invention, the measured value detected by the sensor is the change of the water level in the evaporating pan over time. If the water level does not change within a predetermined time period of e.g. 60 seconds or if its change exceeds a predetermined limiting value, the evaporating cylinder and refrigerator drives are switched off after this time period has elapsed. Should e.g. the water supply be interrupted, water can no longer flow and the water level drops below the predetermined limiting value within the predetermined time period. This causes the flake ice machine to switch off. If either the evaporating cylinder or the refrigerator drive fails, ice production stops and the water level does not change. This also leads to switch-off of the flake ice machine. Should the evaporating cylinder freeze as a result of an excessively low supply temperature, the water level does not change within the time period. This also leads to switch-off of the flake ice machine after elapse of the time period. In the most unfavorable case, all of the liquid in the evaporating pan freezes. In this case, the sensor fails to provide measured values and switch-off of the flake ice machine is also triggered after the predetermined time period has elapsed. In an advantageous manner, monitoring of the changes in the water level over time begins with a delay with respect to the start of operation of the refrigerator. The delay may vary, depending on the type of flake ice machine. A typical value is e.g. 120 seconds. The monitoring control is transition operated.

According to a further advantageous embodiment of the invention, the sensor comprises a floating switch provided on the evaporating cylinder. Advantageously, floating switches are independent of the chemical and physical properties of the freezing liquid used. Therefore, there are e.g. no conductance-related problems when the ice is produced from distilled water. Moreover, should the floating switch be defective due e.g. to a broken cable, contact can no longer be interrupted or established, wherein no change in the water level within the predetermined time period is detected and the flake ice machine is therefore switched off.

Further advantages and advantageous embodiments of the invention can be extracted from the following description, the drawing and the claims.

An embodiment of the invention is shown in the drawing and is described in more detail below.

Figure 1:
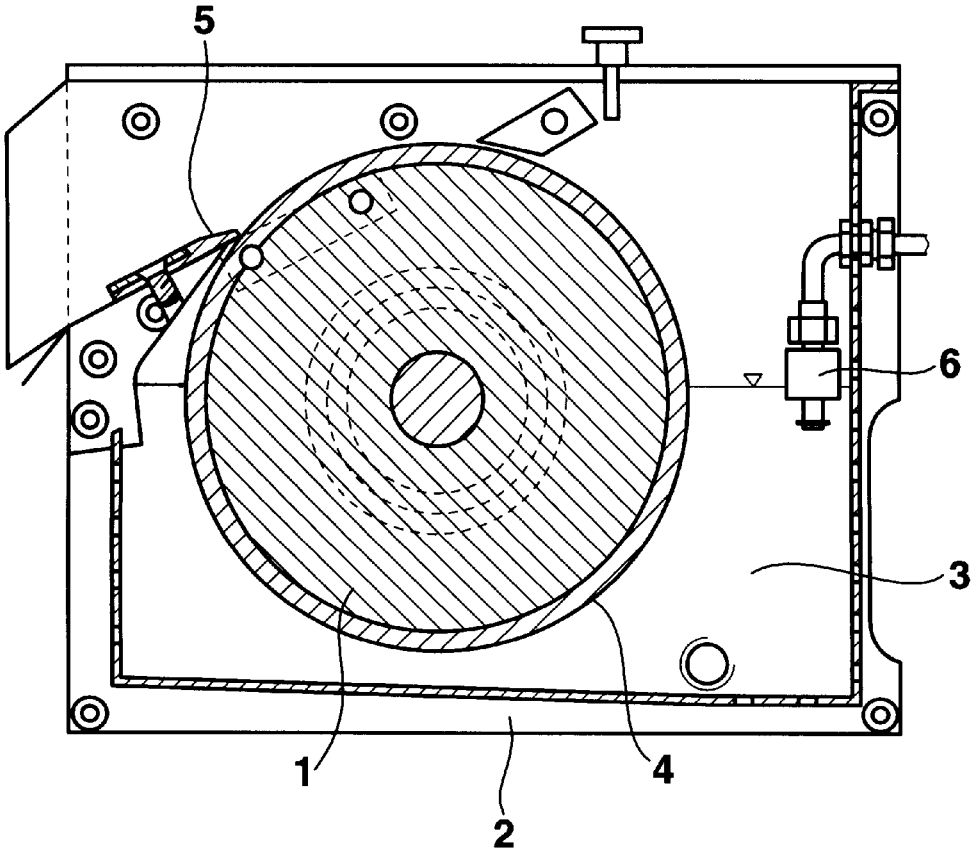
FIG. 1 shows a flake ice machine according to the invention comprising a floating switch.
Figure 2:
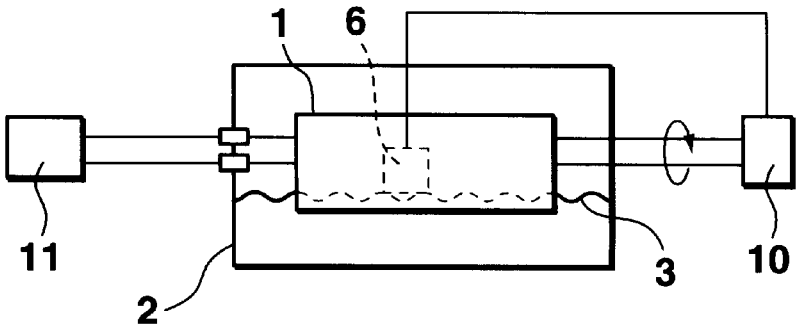
FIG. 2 shows a schematic front view of the flake ice machine in accordance with the invention.

An evaporating cylinder 1 is rotatably supported in an evaporating pan 2 of a flake ice machine and is driven in a rotating manner by an electric or transmission motor 10. The lower part of the evaporating cylinder 1 is inserted into a water bath 3 such that the circumference 4 of the evaporating cylinder 1 is wet with water during rotation. The water freezes on the circumference 4 of the evaporating cylinder 1, which has been cooled by the refrigerator 11. A thin ice layer is thereby formed, which is removed from the circumference by a stationary ice scraper 5 and fed to a collecting container (not shown). The evaporating cylinder drive 10, the refrigerator 11, and the refrigerator 11 drive are conventional units, driven by electric motors. A floating switch 6 is disposed on a side of the evaporating pan 2 and is inserted into the water bath 3. The floating switch detects changes in the water level in the evaporating pan 2 over time. If the water level does not change within a certain amount of time or if its change exceeds a pre-determined limiting value, the control means (not shown), cooperating with the floating switch 6, switches-off the evaporating cylinder 10 and refrigerator drives 11.

All the features shown in the description, in the following claims and in the drawing may be essential to the invention either individually or collectively in any arbitrary combination.

LIST OF REFERENCE NUMBERS

1 evaporating cylinder

2 evaporating pan

3 water bath

4 circumference

5 ice scraper

6 floating switch

10 transmission motor and drive.

11 refrigerator

What is claimed is:

1. Flake ice machine comprising:

a cylindrical evaporating cylinder;

an electric drive means for rotating said evaporating cylinder;

an electrical refrigeration means for guiding coolant through said evaporating cylinder;

an evaporating pan for accepting and containing water, said evaporating cylinder disposed in said evaporating pan to rotate for wetting said evaporating cylinder with water;

means for removing the flake ice from a girth of the evaporating cylinder;

electric control means communicating with said electrical drive means and said electrical refrigerator means; and sensor means for signaling said electrical control means and said electrical refrigerator means, said sensor means measuring a quantity depending on a fill time of said evaporating pan, a thickness of an ice layer on said evaporating cylinder, and on a water level in said evaporating pan, wherein said control means switches off said refrigerator means and said drive means when said measuring quantity does not change or when said measuring quantity exceeds predetermined limiting values.

2. The flake ice machine of claim 1, wherein the measuring value detected by said sensor means corresponds to a change in a water level in said evaporating pan with time.

3. The flake ice machine of claim 1, wherein said sensor means comprises a floating switch disposed at said evaporating pan.

* * * * *